United States Patent [19]

Hauray et al.

[11] 4,108,415

[45] Aug. 22, 1978

[54] ROCKER SUSPENSION SYSTEM

[75] Inventors: Guy J. L. Hauray, Granby; William E. Chapdelaine, Chicopee, both of Mass.

[73] Assignee: Guyray Industries, Inc. (Entire), South Hadley, Mass.

[21] Appl. No.: 796,022

[22] Filed: May 11, 1977

[51] Int. Cl.[2] ..... A45D 19/04

[52] U.S. Cl. ..... 248/370; 248/424; 297/273; 297/281

[58] Field of Search ..... 248/370, 424, 429, 430; 297/261, 273, 276, 281, 282

[56] References Cited

U.S. PATENT DOCUMENTS

| | | | |
|---|---|---|---|
| 281,477 | 7/1883 | Evesson | 297/273 |
| 1,436,481 | 11/1922 | Cook | 248/370 |
| 2,283,000 | 5/1942 | Feldman | 297/273 |

FOREIGN PATENT DOCUMENTS

| | | | |
|---|---|---|---|
| 9,085 | 1/1901 | Norway | 297/273 |
| 7,915 | 1/1897 | Sweden | 297/273 |

*Primary Examiner*—James C. Mitchell

*Attorney, Agent, or Firm*—Clarence A. O'Brien; Harvey B. Jacobson

[57] ABSTRACT

A base defines a pair of horizontally spaced apart front and rear anchor points and a pair of front and rear elongated, upstanding and upwardly divergent support links and have the upper ends thereof pivotally anchored to the front and rear anchor points for oscillation about first parallel axes extending transversely of the links. A support member, including a pair of horizontally spaced apart front and rear anchor locations, is also provided and the lower ends of the front and rear links are pivotally anchored to the front and rear anchor locations for oscillation about second axes paralleling the first axes. A seat structure is supported from the support member in elevated position relative to the latter and the first parallel axes.

9 Claims, 6 Drawing Figures

ROCKER SUSPENSION SYSTEM

BACKGROUND OF THE INVENTION

Various forms of rocker suspensions have been heretofore designed. However, some of these rocker suspensions are not capable of simulating the rearward and backward tilting and forward tilting of a conventional rocker. Also, other forms of rocker suspensions utilize bearing wheels rolling in guide tracks and, therefore, merely glide back and forth.

Examples of various previous forms of rocker suspensions are disclosed in U.S. Pat. Nos. 1,189,178, 1,952,768, 2,597,105, 2,959,210, 3,046,053, 3,170,666, and 3,098,678.

BRIEF DESCRIPTION OF THE INVENTION

The rocker suspension of the instant invention is adapted to be utilized in the construction of a suspended rocking chair seat or bench. A base is provided including opposite side elevated portions each having front and rear horizontally spaced apart anchor points. An elevated horizontally elongated seat structure extends between the opposite side portions of the base and includes opposite side depending support members between which the opposite side elevated portions of the base are received. The lower end of each support member includes horizontally spaced apart front and rear anchor locations and two pairs of opposite end front and rear support links have their upper ends pivotally attached to the corresponding front and rear anchor points of the base while the lower ends of the links are pivotally attached to the corresponding front and rear anchor locations of the seat structure support members. The horizontally elongated seat structure is elevated above the points of pivotal attachment of the upper ends of the links to the front and rear anchor points of the base. The support links are downwardly convergent and the elongated seat structure faces forwardly relative to the base and, accordingly, is tilted forwardly and upwardly when swung rearwardly relative to the base and is tilted forwardly and downwardly when swung forwardly relative to the base. In this manner, the seat structure is suspended from the base to simulate the rocking movement of a conventional rocker equipped seat structure.

The main object of this invention is to provide a suspended seat structure operative to rock back and forth in a manner simulating the back and forth movement of a conventional rocker equipped seat structure.

Another object of this invention is to provide a rocker suspension adaptable in the construction of single and multiple seat rocker structures.

Yet another object of this invention is to provide a rocker suspension which will be operative to utilize relatively inexpensive bearing structures independent of guide tracks or channels.

Another very important object of this invention is to provide a rocker suspension for a seat structure which may be readily constructed from inexpensively available components.

A final object of this invention to be specifically enumerated herein is to provide a rocker suspension in accordance with the preceding objects and which will conform to conventional forms of manufacture, be of simple construction and easy to assemble, so as to provide a device that will be economically feasible, long lasting and relatively trouble-free to assemble.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
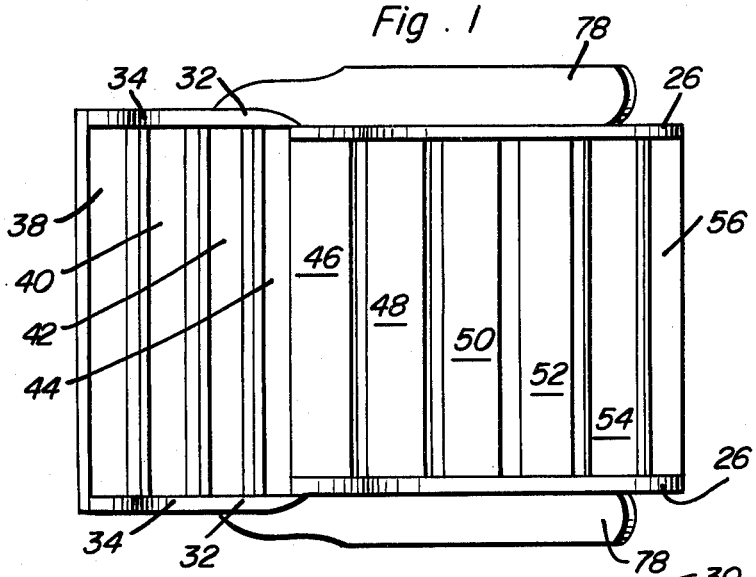
FIG. 1 is a top plan view of a single seat structure utilizing the rocker suspension of the instant invention.
Figure 4:
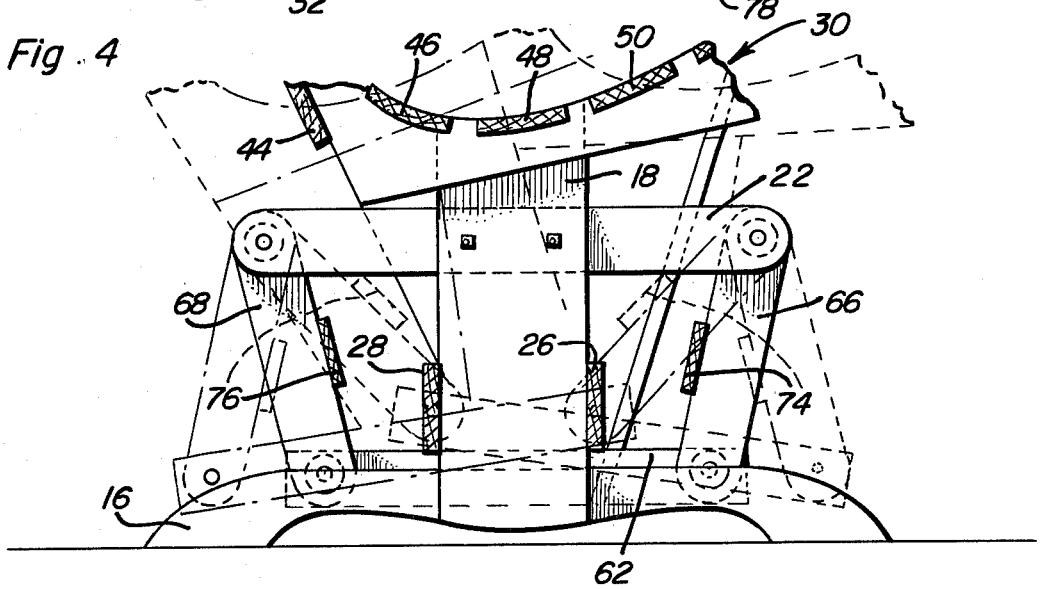
FIG. 4 is an enlarged, fragmentary, vertical sectional view taken substantially upon the plane indicated by the section line 4—4 of FIG. 3 and with alternate limit positions of movement of the rocker suspension illustrated in phantom lines.
Figure 6:
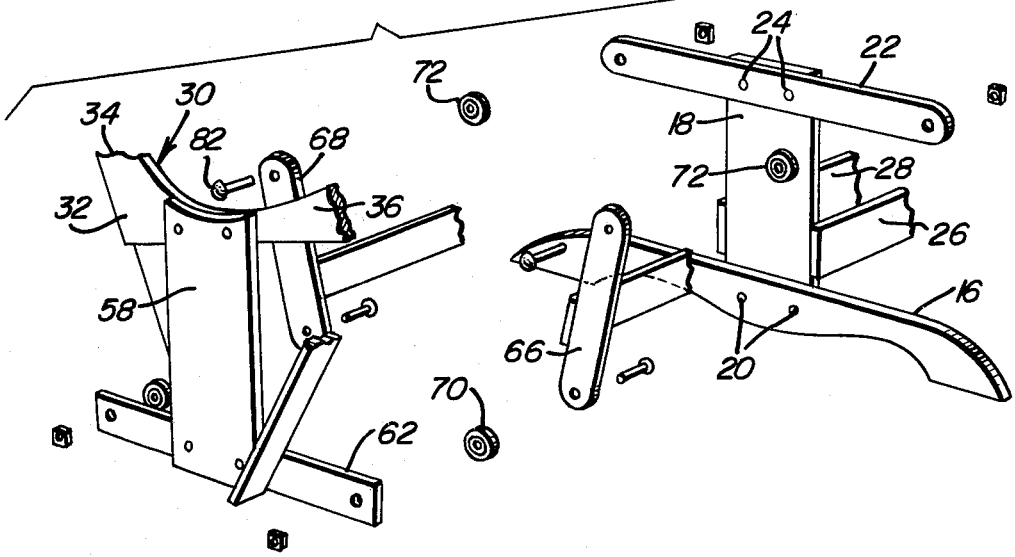
FIG. 6 is an exploded, perspective view of one side portion of the rocker suspension.

Referring now more specifically to the drawings, the numeral 10 generally designates a seat structure incorporating the rocker suspension of the instant invention. The rocker suspension is referred to in general by the reference numeral 12 and includes a base structure referred to in general by the reference numeral 14. The base structure includes a pair of opposite side front to rear extending generally horizontal legs 16 and each leg 16 includes an upright 18 whose lower end is suitably anchored to the corresponding leg 16 by means of suitable fasteners 20. Each upright 18 has a front to rear extending upper support head 22 secured thereto by means of suitable fasteners 24 and the heads 22 project forwardly and rearwardly of the upper ends of the uprights 18. The lower ends of the uprights 18 are braced by means of horizontal front and rear braces 26 and 28 extending therebetween and secured thereto.

The seat structure 10 additionally includes a seat assembly referred to in general by the reference numeral 30. The seat assembly 30 includes a pair of opposite side frames 32 including rearwardly and upwardly inclined arms 34 and arms 36 projecting forwardly from the lower ends of the arms 34. The arms 34 have a plurality of vertically spaced slats 38, 40, 42, and 44 extending and secured therebetween to define a backrest and the arms 36 have a plurality of similar slats 46, 48, 50, 52, 54, and 56 extending and secured therebetween in order to define a seat portion. In addition, the side frames 32 include depending support members 58 anchored at their upper ends to the frames 32 by means of fasteners 60 and carrying front to rear extending lower heads 62 at their lower ends secured thereto by means of suitable fasteners 64. The heads 62 project forwardly and rearwardly of the lower ends of the support members 58 and each side of the rocker suspension 12 includes a pair of front and rear upstanding support links 66 and 68 whose lower ends are oscillatably supported from the front and rear ends of the lower heads 62 by means of bearing assemblies 70. The upper ends of the links 66 and 68 are oscillatably supported from the corresponding front and rear ends of the heads 22 by means of bearing assemblies 72. Still further, the vertical midportions of the links 66 are interconnected by means of a transverse brace 74 extending between and secured to the links 66 and the vertical midportions of the links 68 are interconnected by means of a similar brace member 76. The braces 74 and 76 are swingable rearwardly and forwardly, respectively, into contact with the undersurface portions of the front and rear end portions of the heads 22 to limit rearward and forward swinging movement of the seat assembly 30. Still further, the seat structure 10 includes opposite side arm rests 78 whose rear ends are anchored relative to vertical midportions of the corresponding arms 34 and whose front ends are braced relative to the lower heads 62 by means of inclined braces 80.

Figure 5:
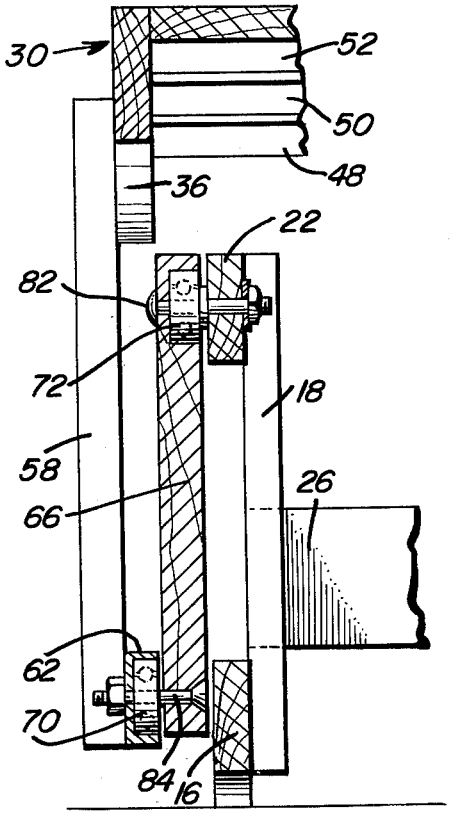
FIG. 5 is an enlarged, fragmentary, vertical sectional view taken substantially upon the plane indicated by the section line 5—5 of FIG. 2.

It may be seen from FIG. 5 of the drawings that the bearings 72 are recessed in the inner sides of the upper ends of the links 66 and 68 and that a fastener 82 is secured through each link upper end, the corresponding bearing 72 and the corresponding end of the associated head 22. Further, the bearings 70 are recessed in the inner sides of the front and rear ends of the lower heads or support members 62 and suitable fasteners 84 are secured through the lower ends of the links 66 and 68, the bearings 70 and the front and rear ends of the lower cross heads or support members 62.

Figure 2:
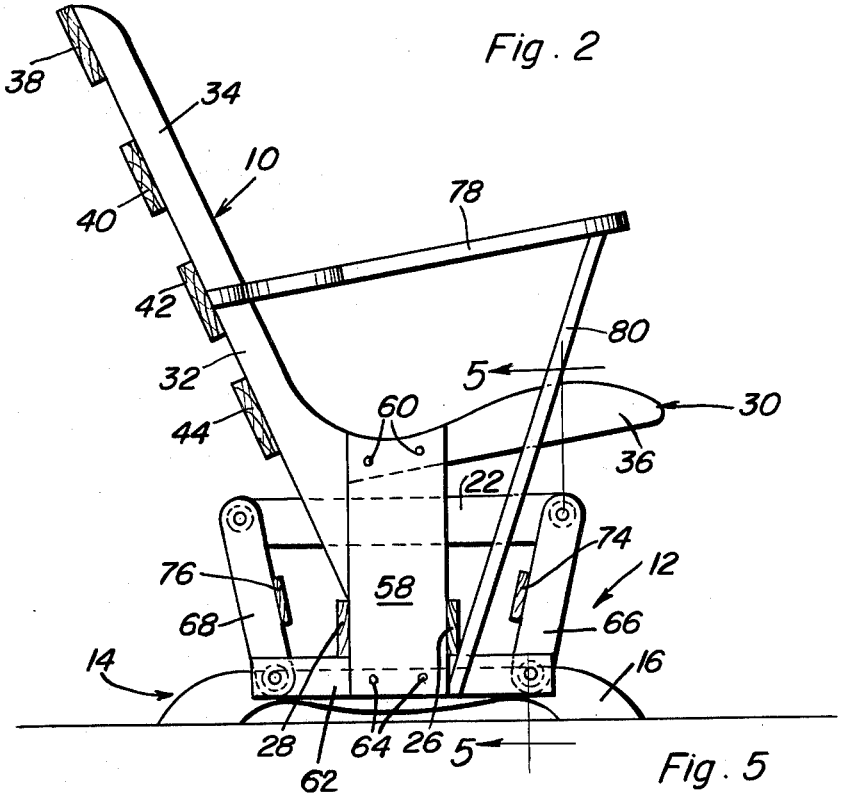
FIG. 2 is a right side elevational view of the seat structure.
Figure 3:
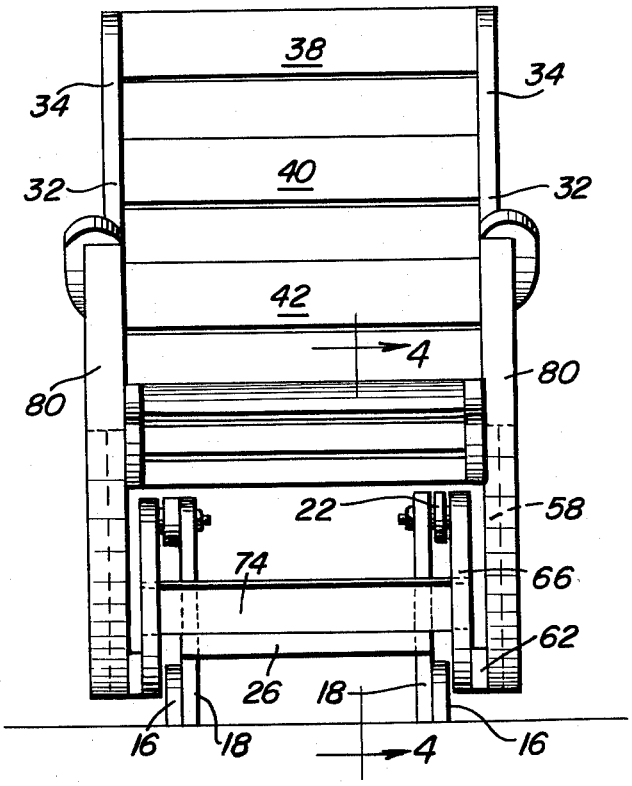
FIG. 3 is a front elevational view of the seat structure.

In operation, when the seat assembly 30 is unoccupied, the uprights 18 assume the vertical positions thereof illustrated in FIG. 2. However, when the seat assembly 30 is occupied and the occupant leans back on the backrest slats 38, 40, 42, and 44, the uprights 18 assume a rearward and upward inclined positions as a result of the seat structure 30 swinging rearwardly from the position thereof illustrated in FIG. 2. Then, when the occupant of the seat assembly shifts his weight forward, the uprights 18 assume forwardly and upwardly inclined positions as a result of forward swinging of the seat assembly 30.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is: as follows:

1. A suspension assembly including a base defining upstanding opposite side uprights adapted at their lower ends for stationary support from a horizontal surface, the upper end portion of each of said uprights including an elongated generally horizontal front to rear extending and projecting support head supported therefrom, each of said heads including a pair of elongated front and rear generally vertical support links whose upper end portions are pivotally supported from the front and rear end portions, respectively, of the corresponding head for oscillation about axes extending transversely of said links and heads, said pairs of links being disposed on the remote sides of said heads and uprights, an upper support structure disposed above said heads and including opposite side portions, said opposite side portions including depending support members supported at their upper end portions from said opposite side portions and disposed outwardly of the remote sides of said uprights and links, the lower end portions of said support members each including front and rear anchor points spaced forward and rearward, respectively, of a vertical transverse plane spaced equally between said axes, the lower end portions of said pairs of links being pivotally anchored to the corresponding anchor points of said support member lower end portions for oscillation relative thereto about axes generally paralleling the first mentioned axes and with said pairs of links spaced inwardly of the opposing sides of said support members and the corresponding anchor points, the approximate vertical midportions of the front and rear pairs of links each including a horizontal transverse brace extending and rigidly secured therebetween, the front brace extending between the front pair of links being lapped over the rear sides of the front links and the rear brace extending between the rear pair of links being lapped over the front sides of the rear links, and the opposite end portions of said front and rear braces being engageable with the underside portions of the front and rear extending portions, respectively, of said heads to limit rearward and forward swinging of said front and rear links, respectively.

2. The combination of claim 1 wherein said support links are convergent toward the lower ends thereof.

3. The combination of claim 1 including a seat structure supported from said support structure.

4. The combination of claim 1 wherein said base includes opposite side front to rear extending foot portions, each foot portion supporting the corresponding upright intermediate its front and rear ends.

5. The combination of claim 4 wherein said support links are convergent toward the lower ends thereof.

6. The combination of claim 4 wherein the lower ends of said links are disposed outwardly of and project downwardly below the upper portions of said foot portions.

7. The combination of claim 6 including front and rear transverse braces extending between and secured to the front and rear sides of said uprights closely above said foot portions.

8. The combination of claim 1 wherein said links are longitudinally straight.

9. A suspension assembly including a base defining upstanding opposite side uprights adapted at their lower ends for stationary support from a horizontal surface, the upper end portions of each of said uprights including an elongated generally horizontal front to rear extending and projecting support head supported therefrom, each of said heads including a pair of elongated front and rear generally vertical support links whose upper end portions are pivotally supported from the front and rear end portions, respectively, of the corresponding head for oscillation about axes extending transversely of said links and heads, said pairs of links being disposed on the remote sides of said heads and uprights, an upper support structure disposed above said heads and including opposite side portions, said opposite side portions including depending support members supported at their upper end portions from said opposite side portions and disposed outwardly of the remote sides of said uprights and links, the lower end portions of said support members each including front and rear anchor points spaced forward and rearward, respectively, of the corresponding uprights, the lower end portions of said pairs of links being pivotally anchored to the corresponding anchor points of said support member lower end portions for oscillation relative thereto about axes generally paralleling the first mentioned axes and with said pairs of links spaced inwardly of the opposite sides of said support members and the corresponding anchor points, said uprights and heads comprising generally T-shaped opposite side support structures from which said upper support structure is supported, by said links, for swinging movement relative to said opposite side support structures, the approximate vertical mid-portions of the front and rear pairs of links each including a horizontal transverse brace extending and rigidly secured therebetween, the front brace extending between the front pairs of links being lapped over the rear sides of the front links and the rear brace extending between the rear pair of links being lapped over the front sides of the rear links, and the opposite end portions of said front and rear braces being engageable with opposing front and rear portions, respectively, of said opposite side support structures to limit rearward and forward swinging of said front and rear links, respectively.

* * * * *